US011225096B2

(12) United States Patent
Yokozawa et al.

(10) Patent No.: US 11,225,096 B2
(45) Date of Patent: Jan. 18, 2022

(54) LIQUID EJECTION APPARATUS, WINDING CONTROL METHOD, AND COMPUTER READABLE RECORDING MEDIUM

(71) Applicants: Suguru Yokozawa, Kanagawa (JP); Suguru Masunaga, Kanagawa (JP); Takuya Okamoto, Kanagawa (JP)

(72) Inventors: Suguru Yokozawa, Kanagawa (JP); Suguru Masunaga, Kanagawa (JP); Takuya Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 71 days.

(21) Appl. No.: 16/788,278

(22) Filed: Feb. 11, 2020

(65) Prior Publication Data

US 2020/0262221 A1 Aug. 20, 2020

(51) Int. Cl.
*B41J 15/16* (2006.01)
*B65H 23/02* (2006.01)
(Continued)

(52) U.S. Cl.
CPC ..... *B41J 15/165* (2013.01); *B41J 13/0027* (2013.01); *B41J 13/03* (2013.01); *B41J 13/28* (2013.01); *B41J 15/046* (2013.01); *B41J 15/16* (2013.01); *B41J 29/38* (2013.01); *B65H 23/005* (2013.01); *B65H 23/025* (2013.01); *B65H 23/198* (2013.01); *B65H 26/08* (2013.01); *B65H 29/125* (2013.01); *B65H 2301/33312* (2013.01);
(Continued)

(58) Field of Classification Search
CPC ..... B41J 15/165; B41J 13/0027; B41J 13/28; B41J 13/03; B41J 29/38; B41J 15/046; B41J 15/16; B65H 29/125; B65H 23/005; B65H 26/08; B65H 23/025; B65H 23/198; B65H 2553/51; B65H 2403/942; B65H 2404/1452; B65H 2301/33312; B65H 2403/732; B65H 2557/2644; B65H 2301/4493
See application file for complete search history.

(56) References Cited

U.S. PATENT DOCUMENTS 5,970,872 A * 10/1999 Iwamoto ..... G03G 15/2014 101/423
2014/0151491 A1 6/2014 Mizutani et al.
(Continued)

FOREIGN PATENT DOCUMENTS

JP S61-172768 8/1986
JP 2011-088366 5/2011
(Continued)

*Primary Examiner* — Yaovi M Ameh
(74) *Attorney, Agent, or Firm* — Duft & Bornsen, PC

(57) ABSTRACT

A liquid ejection apparatus includes a conveying unit, a winding unit, a printing unit, and a rotation control unit. The conveying unit is configured to intermittently convey a printing medium by a predetermined feed amount. The winding unit is configured to wind the printing medium conveyed by the conveying unit. The printing unit is configured to perform printing on the conveyed printing medium. The rotation control unit is configured to control the winding unit to rotate in a winding direction at a predetermined timing after the conveying unit has started to convey the printing medium intermittently, and then cause the winding unit to rotate in a reverse direction opposite to the winding direction.

14 Claims, 16 Drawing Sheets

(51) Int. Cl.

| | |
|---|---|
| ***B41J 13/00*** | (2006.01) |
| ***B41J 13/28*** | (2006.01) |
| ***B41J 13/03*** | (2006.01) |
| ***B41J 29/38*** | (2006.01) |
| ***B65H 29/12*** | (2006.01) |
| ***B65H 23/00*** | (2006.01) |
| ***B65H 26/08*** | (2006.01) |
| ***B65H 23/025*** | (2006.01) |
| ***B65H 23/198*** | (2006.01) |
| ***B41J 15/04*** | (2006.01) |

(52) U.S. Cl.

CPC ..... *B65H 2301/4493* (2013.01); *B65H 2403/732* (2013.01); *B65H 2403/942* (2013.01); *B65H 2404/1452* (2013.01); *B65H 2553/51* (2013.01); *B65H 2557/2644* (2013.01)

(56) References Cited

U.S. PATENT DOCUMENTS

| | | | | |
|---|---|---|---|---|
| 2015/0054898 | A1 | 2/2015 | Kondo et al. | |
| 2015/0178602 | A1* | 6/2015 | Kusakabe ..... | G06K 15/1805 358/1.15 |
| 2016/0121626 | A1 | 5/2016 | Masunaga et al. | |
| 2017/0151815 | A1 | 6/2017 | Masunaga et al. | |
| 2018/0215179 | A1* | 8/2018 | Akahane ..... | B65H 23/1888 |

FOREIGN PATENT DOCUMENTS

| | | |
|---|---|---|
| JP | 5765562 | 8/2015 |
| JP | 2016-016946 | 2/2016 |
| JP | 2017-128024 | 7/2017 |

* cited by examiner

LIQUID EJECTION APPARATUS, WINDING CONTROL METHOD, AND COMPUTER READABLE RECORDING MEDIUM

CROSS-REFERENCE TO RELATED APPLICATIONS

The present application claims priority under 35 U.S.C. § 119 to Japanese Patent Application No. 2019-024942, filed on Feb. 14, 2019, and Japanese Patent Application No. 2019-239822, filed on Dec. 27, 2019. The contents of which are incorporated herein by reference in their entirety.

BACKGROUND OF THE INVENTION

1. Field of the Invention

The present invention relates to a liquid ejection apparatus, a winding control method, and a computer readable recording medium.

2. Description of the Related Art

An image forming apparatus, such as an inkjet printing apparatus, that performs printing by a serial head method on a roll type medium (hereinafter, may also be simply referred to as a medium) that is a printing medium, such as a paper medium or a vinyl chloride medium, wound around a winding core has been known. The printed roll type medium is subjected to a winding process based on a predetermined winding method by a winding mechanism in order to prevent the roll type medium from bending, getting dirty, or the like.

As a general winding method, a series winding method has been known. As disclosed in Japanese Unexamined Patent Application Publication No. 61-172768, the series winding method is a method of winding a roll type medium by a winding motor with constant winding torque via a mechanism (for example, a torque limiter) that can control torque on a winding shaft. The winding mechanism of the series winding method has a simple structure, is available at low cost, and performs winding operation while applying predetermined tension to a printed roll type medium, so that wrinkles are less likely to occur.

However, if the roll type medium is conveyed while applying predetermined tension to the roll type medium, right and left end portions of the roll type medium are likely to be subjected to forces. Therefore, it is desirable to convey the roll type medium while applying equal forces to the right and left sides, but if there is a difference between the force applied to the right side and the force applied to the left side of the roll type medium, inclination (skew) occurs. Meanwhile, if the roll type medium is conveyed without applying tension to the roll type medium, there is little influence due to a difference between the force applied to the right side and the force applied to the left side.

If the inclination as described above occurs, the following inconvenience may occur: "the roll type medium comes in contact with a side plate and is damaged, so that it becomes difficult to perform conveyance", "image formation on a platen is influenced and image quality is reduced", and "it becomes difficult to equally wind the right and left sides, so that it becomes difficult to continuously perform winding around a winding shaft.

Here, if only a loosened portion is wound in such a manner that tension is not applied, it becomes possible to perform conveyance and winding without causing a difference between the tension on the right side and the tension on the left side. However, in this case, tightening on the winding shaft may be reduced and it becomes difficult to equally perform winding on the winding side.

Japanese Unexamined Patent Application Publication No. 2016-016946 discloses a printing apparatus that controls ON and OFF of winding operation and controls switching between operation of intentionally forming looseness and operation of performing winding while applying tension at least once, in accordance with a conveying timing. With this configuration, it is possible to reduce a difference between the tension on the right side and the tension on the left side, and it is also possible to obtain tension needed to perform winding.

However, in the printing apparatus disclosed in Japanese Unexamined Patent Application Publication No. 2016-016946, only by controlling switching of the operation in accordance with the conveying timing as described above, the center of the wound medium is gradually offset and balance with respect to the winding shaft changes. Consequently, the wound medium may be loosened and hang down to the ground, and the printed matter may get dirty, which is inconvenient. Further, rotation is inclined in a direction in which the tension is applied and skew increases, which is a problem. Furthermore, in the printing apparatus disclosed in Japanese Unexamined Patent Application Publication No. 2016-016946, it is difficult to equalize a looseness amount, so that the tension applied to a printing surface varies and printing quality is reduced, which is a problem.

SUMMARY OF THE INVENTION

According to an aspect of the present invention, a liquid ejection apparatus includes a conveying unit, a winding unit, a printing unit, and a rotation control unit. The conveying unit is configured to intermittently convey a printing medium by a predetermined feed amount. The winding unit is configured to wind the printing medium conveyed by the conveying unit. The printing unit is configured to perform printing on the conveyed printing medium. The rotation control unit is configured to control the winding unit to rotate in a winding direction at a predetermined timing after the conveying unit has started to convey the printing medium intermittently, and then cause the winding unit to rotate in a reverse direction opposite to the winding direction.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
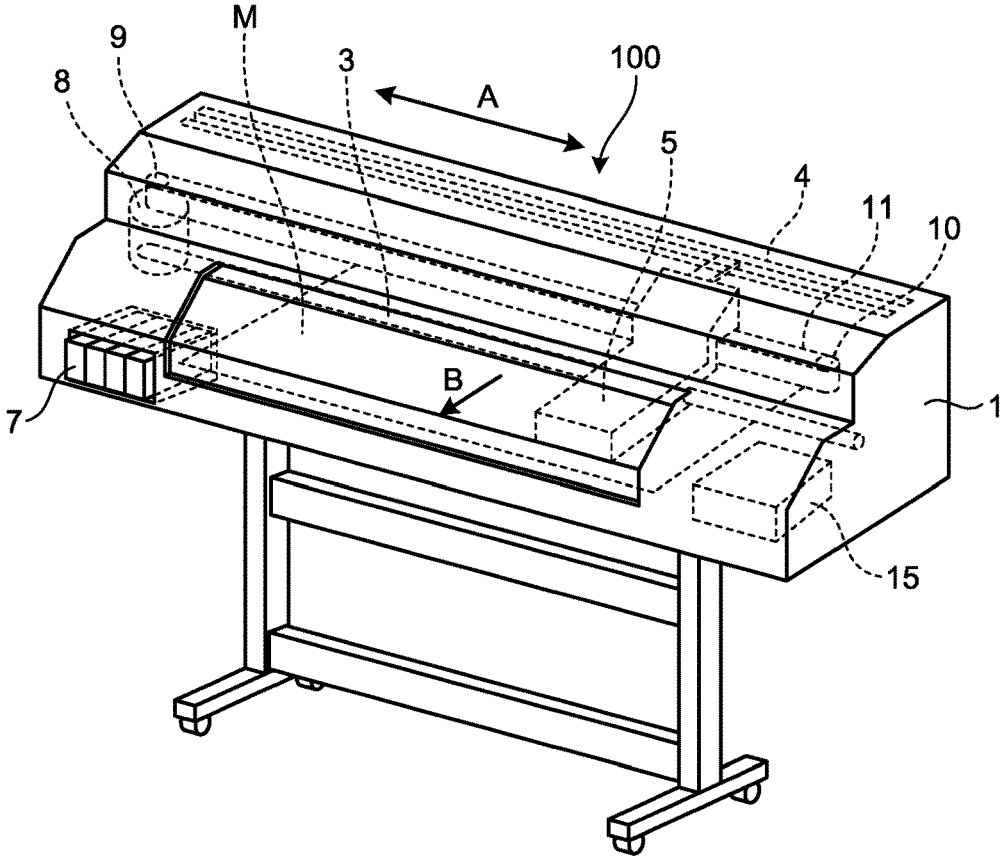
FIG. 1 is a diagram illustrating an external appearance of an image forming apparatus according to an embodiment and is a transparent view of main parts.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment has an object to provide a liquid ejection apparatus, a winding control method, and a computer readable recording medium capable of preventing deformation and skew of a printing medium that is wound in a roll shape and improving printing quality.

Embodiments of an image forming apparatus as one example of a liquid ejection apparatus, a winding control method, and a computer readable recording medium storing therein a winding control program will be described below with reference to the accompanying drawings.

External Configuration

FIG. 1 is a perspective view illustrating an external appearance of an image forming apparatus 100 according to an embodiment. As one example, the image forming apparatus 100 according to the embodiment is what is called an inkjet type image forming apparatus. A guide rod 3 and a sub guide rail 4 are extended between both side plates inside a main body 1. A carriage 5 is held by the guide rod 3 and the sub guide rail 4 in such a manner that the carriage 5 can move in a direction of arrow A (in a main-scanning direction).

A timing belt 11 extended between a drive pulley 9 and a pressure pulley 10 is connected to the carriage 5. The timing belt 11 is driven by a main-scanning motor 8 via the drive pulley 9, so that the carriage 5 reciprocates in the main-scanning direction A. Tension is applied to the timing belt 11 by the pressure pulley 10. Therefore, the carriage 5 is driven without being loosened.

Carriage Scanning Mechanism

Figure 2:
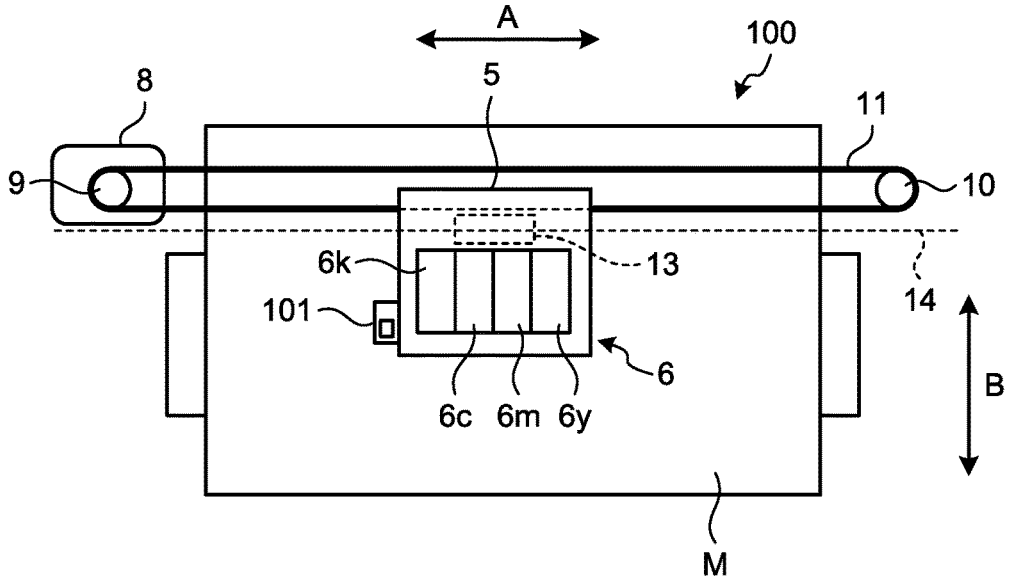
FIG. 2 is a top view of a carriage scanning mechanism of the image forming apparatus according to the embodiment.

FIG. 2 is a plan view of a carriage scanning mechanism. In FIG. 2, a recording medium M is intermittently conveyed along a direction of arrow B (in a sub-scanning direction) below the carriage 5 that reciprocates. Recording heads 6*k*, 6*c*, 6*m*, and 6*y* eject ink from a plurality of nozzles toward the recording medium M. Accordingly, a predetermined image, character, or the like is printed on the recording medium M. Meanwhile, "k" indicates black or a key plate, "c" indicates cyan, "m" indicates magenta, and "y" indicates yellow. Further, the ink is one example of liquid. As one example, water-based ink, ultraviolet (UV)-curable ink, electron beam curable ink, solvent ink, and the like may be used as the ink.

Furthermore, a cartridge 7 that supplies ink to the recording head 6 and a maintenance mechanism 15 that performs maintenance of the recording head 6 mounted on the carriage 5 are arranged in the main body 1 of the image forming apparatus 100. An encoder sensor 13 is arranged in the carriage 5. The encoder sensor 13 continuously reads an encoder sheet 14 that is extended between both side plates, and detects a position of the carriage 5 in the main-scanning direction. Movement of the carriage 5 is controlled between the two side plates on the basis of the position in the main-scanning direction detected by the encoder sensor 13. Moreover, an imaging unit 101 that moves together with the carriage 5 is arranged in the carriage 5. The imaging unit 101 reads a color patch of a reference chart and performs a color measurement process for each type of paper.

Conveying Configuration

Figure 3:
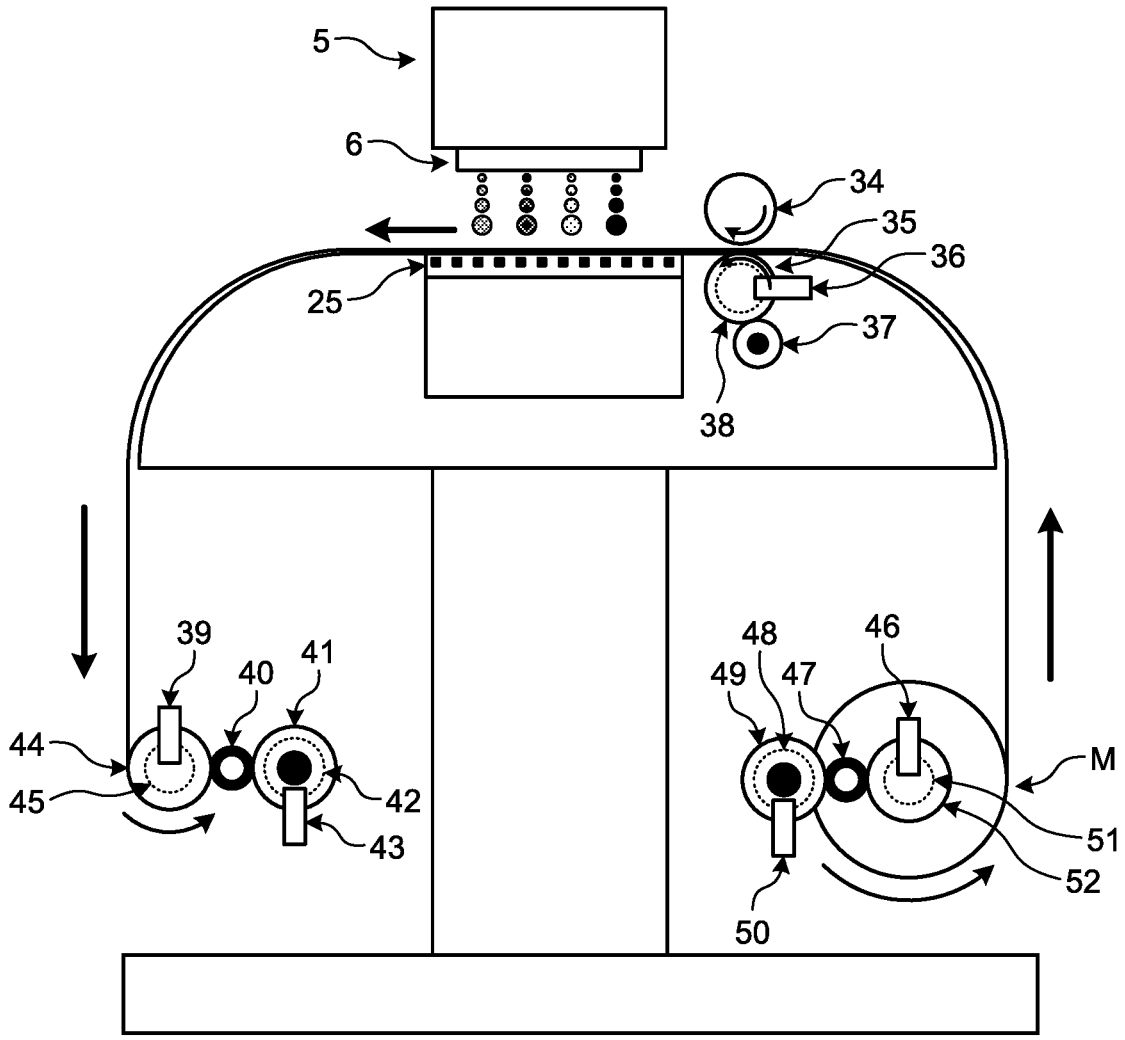
FIG. 3 is a diagram for explaining a conveying mechanism for conveying a roll type medium.

FIG. 3 is a diagram for explaining a conveying mechanism for conveying the roll type medium M (one example of a printing medium). For example, a paper medium, a vinyl chloride medium, or the like may be used as the roll type medium M that is one example of the printing medium. In FIG. 3, the recording head 6 is mounted on the carriage 5 and printing is performed on a platen 25 (one example of a printing unit). The roll type medium M is set in a paper feed unit in a manner of being wound around a paper feed paper tube 52, and rotationally pulled in a direction of arrow. Accordingly, the roll type medium M passes through a printing region on the platen 25 via a conveying roller 35 (one example of a conveying unit) of a conveying unit, and wound around a winding paper tube 44 (one example of a winding unit) that is set in a winding unit.

The winding unit includes a winding encoder sheet 45 that detects an amount of rotation of the winding paper tube 44, a winding encoder sensor 39, and a torque limiter 40 that is drivingly connected to the winding paper tube 44 and that manages an upper limit of torque applied to the roll type medium M. Further, the winding unit includes a winding motor 41 that serves as a drive source when winding and loosening operation is performed, a winding motor encoder sheet 42 that is mounted on a motor shaft to detect a rotation speed and a rotation amount of the motor, and a winding motor encoder sensor 43.

The paper feed unit includes a paper feed remaining amount encoder sheet 51 that detects a rotation amount of the paper feed paper tube 52, a paper feed remaining amount encoder sensor 46, and a torque limiter 47 that determines tension to be applied to the roll type medium M. Further, the paper feed unit includes a paper feed motor 49 that serves as a drive source for generating tension on the paper feed side, a paper feed motor encoder sheet 48 that is mounted on a motor shaft to detect a rotation speed and a rotation amount of the paper feed motor 49, and a paper feed motor encoder sensor 50.

During printing, the paper feed motor 49 is caused to rotate and if a force is applied in a direction opposite to the conveying direction as indicated by an arrow in FIG. 3, tension is applied to the roll type medium M that is held by the conveying roller 35 and a pressurizing roller 34, so that the torque limiter 47 starts to slide. Accordingly, it is possible to apply paper feed tension generated by the torque limiter 47 to the roll type medium M.

The conveying unit includes a conveying motor 37 that serves as a drive source for rotating the conveying roller 35, and a conveying motor encoder sheet 38 and a conveying motor encoder sensor 36 that are mounted on a shaft of the conveying roller 35 to detect a rotation speed and a rotation amount of the conveying motor 37.

Figure 4:
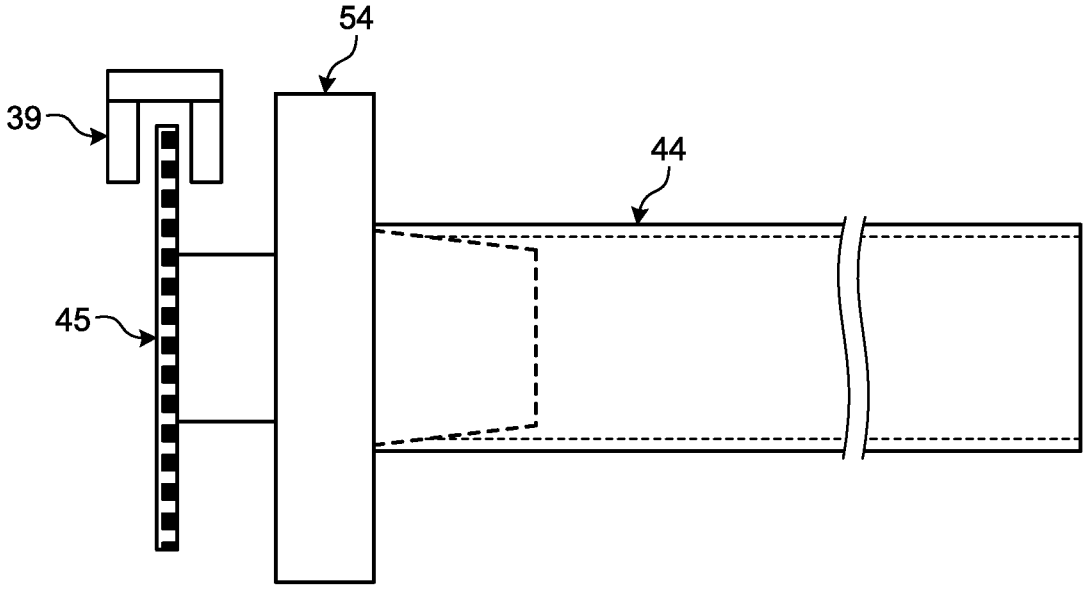
FIG. 4 is a diagram for explaining a winding paper tube and a peripheral mechanism of the winding paper tube.

Further, as illustrated in FIG. 4, the winding paper tube 44 is held by being sandwiched by a flange 54 from right and left sides. The winding paper tube 44 rotates when the flange 54 is rotated by the winding motor 41 via the torque limiter 40. Furthermore, the encoder sheet 45 is mounted on a shaft of the flange 54. The winding encoder sensor 39 outputs an encoder pulse corresponding to the rotation speed of the encoder sheet 45. A rotation amount, a rotation position, a rotation speed, and the like of the winding paper tube 44 are calculated based on a pulse number of the encoder pulse.

While the configuration of the winding paper tube 44 has been described with reference to FIG. 4, the paper feed paper tube 52 has the same configuration. Details are the same as described above with reference to FIG. 4.

Main/Sub Drive Control Unit

Figure 5:
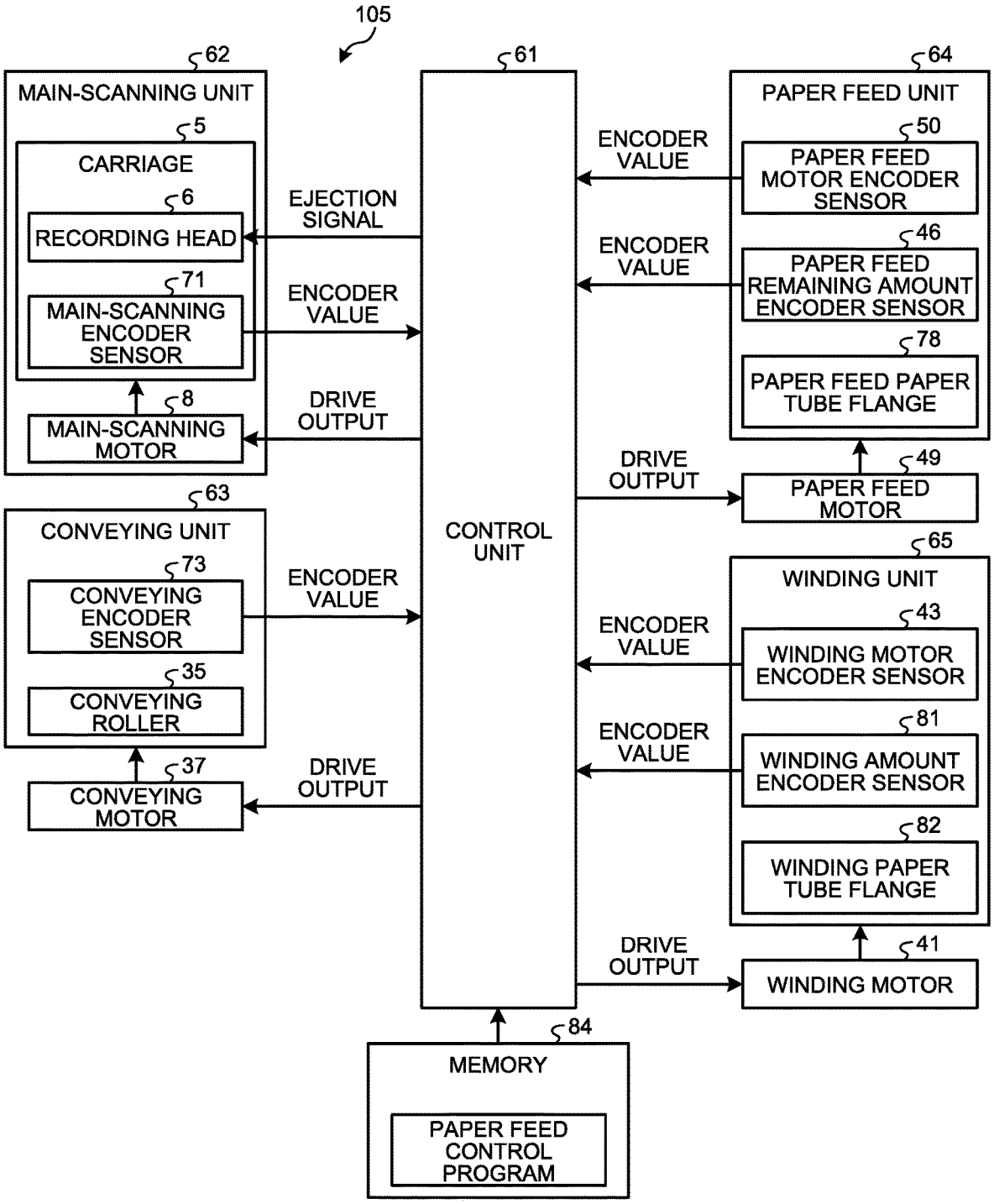
FIG. 5 is a block diagram of the image forming apparatus according to the embodiment.

FIG. 5 is a block diagram of a main/sub drive control unit 105 of the image forming apparatus 100. As illustrated in FIG. 5, the image forming apparatus 100 includes, as the main/sub drive control unit 105, a control unit 61 (one example of a rotation control unit), a main-scanning unit 62, a conveying unit 63, a paper feed unit 64, and a winding unit 65.

The main-scanning unit 62 includes the main-scanning motor 8, the carriage 5 that is driven by the main-scanning motor 8, and the recording head 6 and a main-scanning encoder sensor 71 that are mounted on the carriage 5.

The conveying unit 63 includes the conveying roller 35 that is driven by the conveying motor 37, and a conveying encoder sensor 73 that outputs an encoder pulse that varies with rotation of the conveying roller 35.

The paper feed unit 64 includes a paper feed paper tube flange 78 that is driven by the paper feed motor 49, the paper feed motor encoder sensor 50 that outputs an encoder pulse that varies with rotation of the paper feed motor 49, and the paper feed remaining amount encoder sensor 46 that outputs an encoder pulse that varies with rotation of the paper feed paper tube 52.

The winding unit 65 includes a winding paper tube flange 82 that is driven by the winding motor 41, and the winding motor encoder sensor 43 that outputs an encoder pulse that varies with rotation of the winding motor 41. Further, the winding unit 65 includes a winding amount encoder sensor 81 that outputs an encoder pulse that varies with rotation of the winding paper tube 44.

In other words, the winding unit 65 includes the two encoders such as the winding motor encoder sensor 43 that detects rotation of the motor shaft and the winding amount encoder sensor 81 that detects rotation of the paper tube (flange). Therefore, it is possible to obtain two encoder values from the winding unit 65. Consequently, during looseness control, it is possible to control a looseness amount with high accuracy by performing feedback using an encoder value of the winding amount encoder sensor 81 as an input value and controlling rotation of the winding motor 41.

Further, it may be possible to perform feedback control on the winding motor 41 using an encoder value of the winding motor encoder sensor 43 and periodically change a target value of the winding motor encoder sensor 43, such as once every 100 milliseconds (msec) or once every 200 msec, in accordance with a difference between a target value of the winding motor encoder sensor 43 and a target value of the winding amount encoder sensor 81.

In the following description, it is assumed that the rotation of the motor is controlled based on the encoder value that is fed back from the motor encoder sensor and that corresponds to rotation of the motor shaft.

Functions of Control Unit

Figure 6:
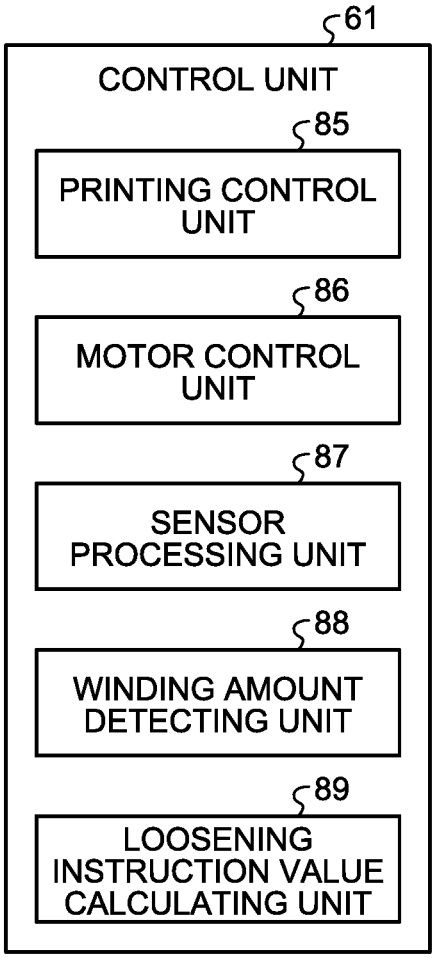
FIG. 6 is a functional block diagram of a control unit of the image forming apparatus according to the embodiment.

FIG. 6 is a functional block diagram of the control unit 61. The control unit 61 executes a paper feed control program (one example of a winding control program) stored in a memory illustrated in FIG. 5, and implements each of functions of a printing control unit 85, a motor control unit 86, a sensor processing unit 87, a winding amount detecting unit 88, and a loosening instruction value calculating unit 89 as illustrated in FIG. 6.

In this example, the printing control unit 85 to the loosening instruction value calculating unit 89 are implemented by software, but a part or all of these units may be implemented by hardware, such as an integrated circuit (IC). Further, the functions implemented by the printing control unit 85 to the loosening instruction value calculating unit 89 may be realized by the single paper feed control program, or it may be possible to cause a different program to execute a part of processes or it may be possible to indirectly perform processes using a different program.

Furthermore, the paper feed control program may be provided by being recorded in a computer readable recording medium, such as a compact disk read only memory (CD-ROM) or a flexible disk (FD), in an installable or executable file format. Moreover, the paper feed control program may be provided by being recorded in a computer readable recording medium, such as a CD-recordable (CD-R), a digital versatile disk (DVD), a Blu-ray (registered trademark) disk, or a semiconductor memory. Furthermore, the paper feed control program may be provided by being installed via a network, such as the Internet, or may be provided by being incorporated in a ROM or the like in advance in the apparatus.

The printing control unit 85 gives a drive instruction to each of the main-scanning motor 8, the conveying motor 37, the paper feed motor 49, and the winding motor 41. As each of the motors 8, 37, 49, and 41, for example, a direct current (DC) motor may be used. The motor control unit 86 refers to an encoder value detected by the sensor processing unit 87, and performs speed control and positioning control (position control) on each of the motors 8, 37, 49, and 41 through feedback control as described below.

Further, when the winding paper tube 44 is rotated, a loosened amount varies depending on a winding outer diameter, so that a rotation amount is changed depending on the outer diameter. With this configuration, it is possible to generate a constant looseness amount without influence of the outer diameter. The winding amount detecting unit 88 detects an outer diameter of the roll type medium M wound around the winding paper tube 44, on the basis of a count value of the encoder value that is detected by the sensor processing unit 87 and that is output by the winding motor encoder sensor 43. Details will be described later.

The loosening instruction value calculating unit 89 calculates a loosening instruction value that is a rotation pulse number with respect to a loosening direction of the winding motor 41 so as to obtain a desired looseness amount, from the winding outer diameter value that is calculated by the winding amount detecting unit 88.

Feedback Control Mode

Figure 7:
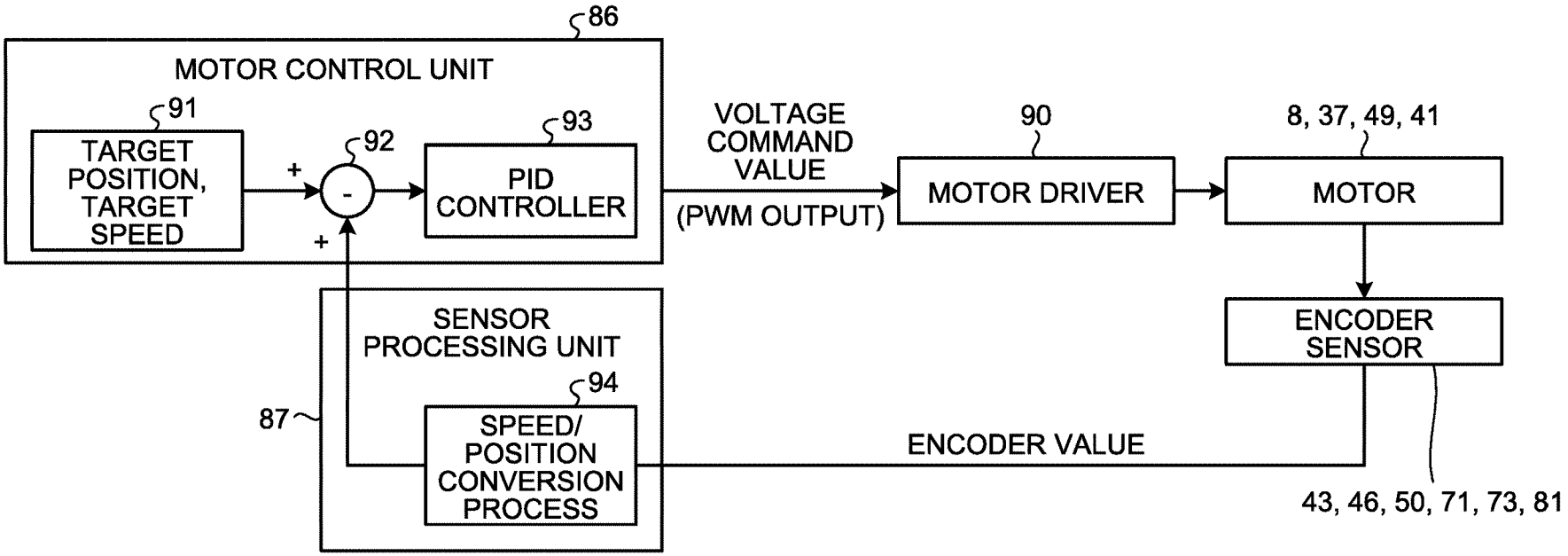
FIG. 7 is a diagram illustrating a feedback control mode of a main-scanning motor, a conveying motor, a paper feed motor, and a winding motor in the image forming apparatus according to the embodiment.

FIG. 7 is a diagram illustrating a feedback control mode of the main-scanning motor 8, the conveying motor 37, the paper feed motor 49, and the winding motor 41 in the image forming apparatus 100 according to the embodiment. As one example, in FIG. 7, the motor control unit 86 and the sensor processing unit 87 are realized by software based on the paper feed control program as described above. Further, a motor driver 90, each of the motors 8, 37, 49, and 41, and the encoder sensors 43, 46, 50, 71, 73, and 81 are realized by hardware.

In FIG. 7, the motor control unit 86 causes a target generating unit 91 to generate target positions and target speeds of the motors 8, 37, 49, and 41. A proportional integral differential (PID) controller 93 generates voltage command values corresponding to the target positions and the target speeds, and supplies the voltage command values to the motor driver 90. As one example, the voltage command values are supplied to the motor driver 90 in a signal mode of a pulse width modulation signal (PWM signal).

The motor driver 90 causes the motors 8, 37, 49, and 41 to rotate by applying driving voltages corresponding to the voltage command values to the motors 8, 37, 49, and 41. The encoder sensors 43, 46, 50, 71, 73, and 81 generate encoder pulses corresponding to the rotation speeds of the motors 8, 37, 49, and 41, and supply the encoder pulses to the sensor processing unit 87. The sensor processing unit 87 detects current rotation speeds and current rotation positions of the motors 8, 37, 49, and 41 on the basis of the encoder pulse, and feeds them back to the motor control unit 86. The motor control unit 86 causes a comparing unit 92 to detect a difference between each of the target positions and the target speeds generated by the target generating unit 91 and each of the current rotation positions and the current rotation speeds that are fed back, and supplies a differential signal to the PID controller 93.

The PID controller 93 generates voltage command values by which the difference indicated by the differential signal, i.e., the difference between each of the target positions and the target speeds generated by the target generating unit 91 and each of the current rotation positions and the current rotation speeds that are fed back, becomes zero (0), and supplies the voltage command value to the motor driver 90. Accordingly, each of the motors 8, 37, 49, and 41 rotates at the target position and the target speed generated by the target generating unit 91.

Looseness Control

Figure 8:
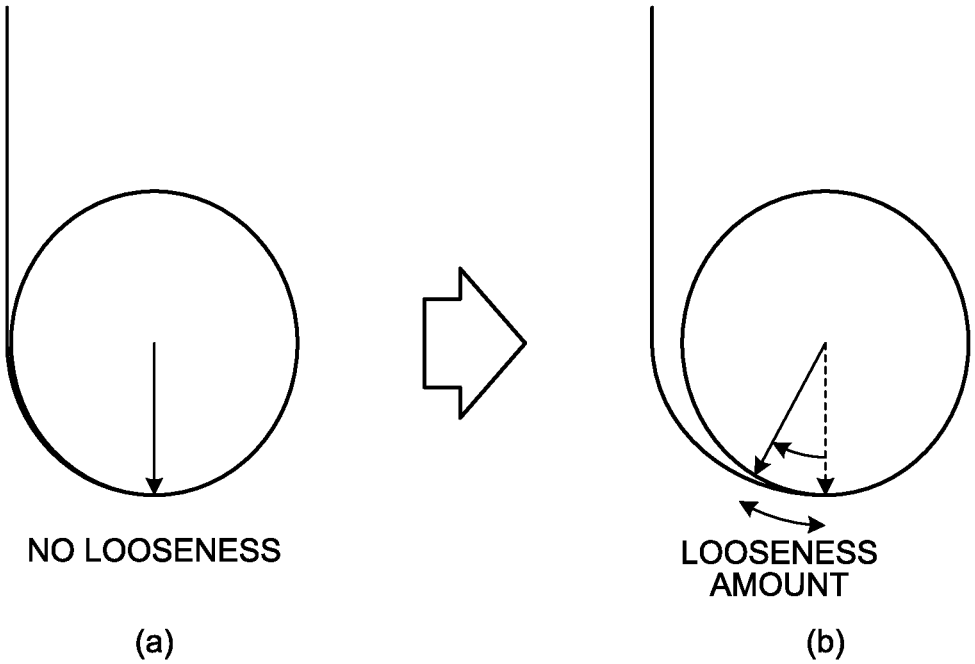
FIG. 8 is a diagram for explaining a looseness amount of the roll type medium.

The looseness amount of the roll type medium M will be described below with reference to FIG. 8. The looseness amount is represented by a length of the roll type medium M and corresponds to a length of an outer circumference of a wound media when described with reference to the winding shaft. For example, a state in which the looseness amount is 10 millimeters (mm) is a state in which the roll type medium M wound around the winding paper tube 44 is conveyed by 10 mm from a state in which there is no looseness. This state equals to the state in which the medium is conveyed by 10 mm by the conveying roller 35 from the state in which the medium is not wound.

Looseness Control Operation

Figure 9:
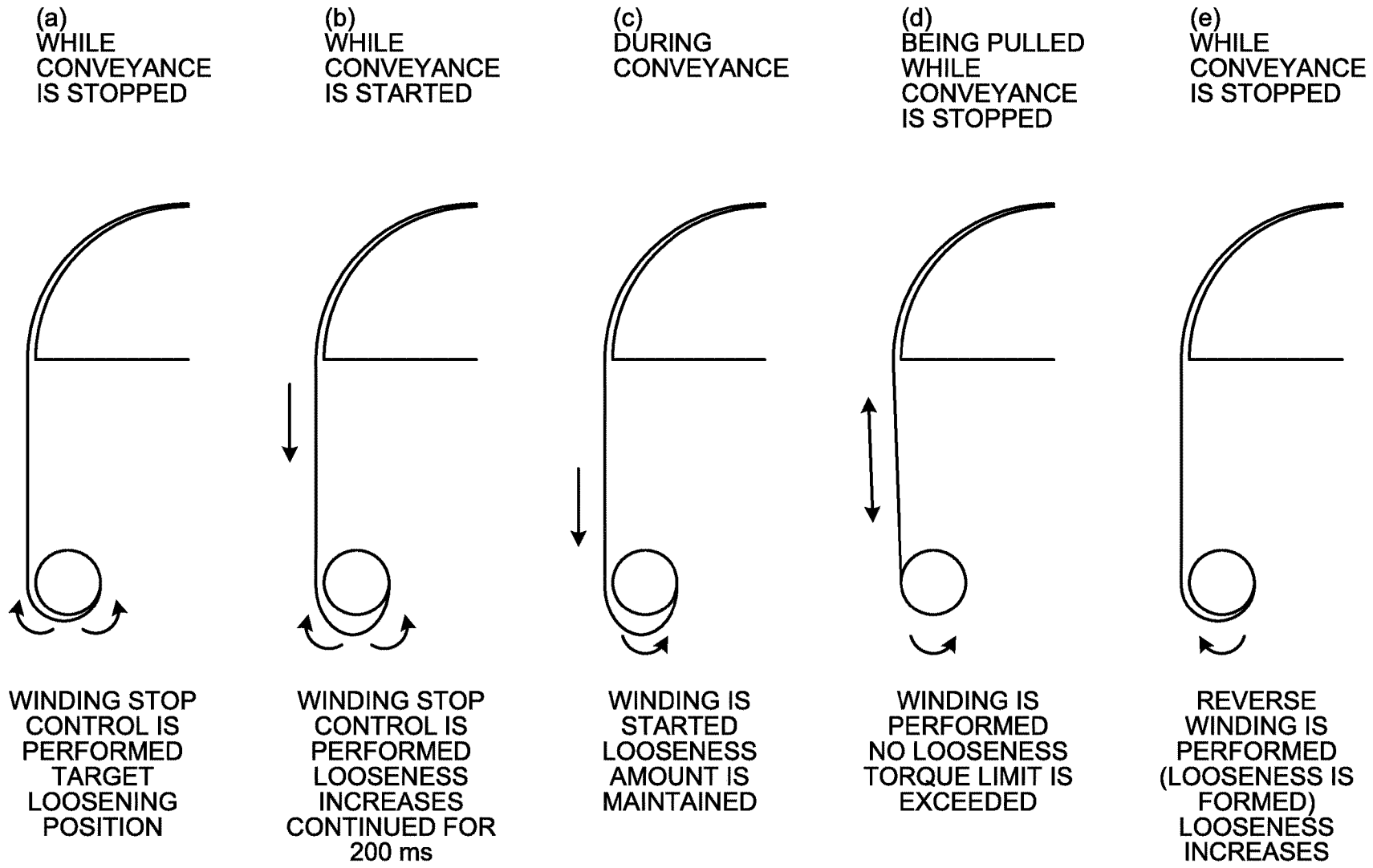
FIG. 9 is a diagram for explaining looseness control operation in the image forming apparatus according to the embodiment.

Looseness control operation will be described below with reference to FIG. 9. First, FIG. 9 illustrates, at (a), a state in which conveyance is stopped immediately before conveyance by the conveying roller 35 is performed. In this state, the winding paper tube 44 is subjected to positioning stop control by the winding motor 41 in such a manner that a desired loosening position is maintained. Meanwhile, positioning control is performed by the feedback control that is described above with reference to FIG. 7. In other words, if the winding motor encoder sensor 43 detects occurrence of positional deviation from a desired position, control of returning the rotation position of the winding motor 41 to the desired position is repeated. With this control, the conveying roller 35 keeps stopping at the desired position.

FIG. 9 illustrates, at (b), a state in which conveyance of the roll type medium M is started and the looseness amount increases. At the start of the conveyance, winding stop control is continued.

FIG. 9 illustrates, at (c), a state of the roll type medium M that is being conveyed after a lapse of a predetermined time, such as 200 ms, since start of conveyance. By starting winding operation as illustrated at (c) in FIG. 9 after a lapse of a predetermined time, such as 100 ms to 500 ms, since start of conveyance operation, it is possible to prevent inconvenience such as an increase in the tension at the beginning of conveyance. If the winding motor 41 is driven and winding of the roll type medium M is started, extra looseness does not occur, so that the looseness amount is maintained until conveyance of the roll type medium M is stopped.

FIG. 9 illustrates, at (d), a state in which conveyance of the roll type medium M is stopped and the winding motor 41 continues to perform winding. In this state, the looseness amount reaches zero (0), so that the conveying roller 35 and the winding paper tube 44 pull the roll type medium M in opposite directions. In this case, the winding motor 41 does not stop and the torque limiter 40 slides, so that winding is performed at the tension of the torque limiter 40. Accordingly, it is possible to perform winding tightly and improve winding quality, so that it is possible to accurately detect the outer diameter of the roll type medium M wound around the winding paper tube 44.

FIG. 9 illustrates, at (e), a state in which the winding motor 41 is rotated reversely (rotated in a direction opposite to a winding direction of the roll type medium M) in order to intentionally form looseness while conveyance is stopped. After a lapse of a predetermined time since end of conveyance, switching to reverse rotation operation is started. The "predetermined time" is a time until winding operation of the roll type medium M around the winding paper tube 44 is completed. By adjusting the rotation speed of the winding motor 41 in accordance with the outer diameter of the wound roll type medium M, it is possible to set the "predetermined time" until start of the switching to the reverse rotation operation to a certain time, such as 100 msec or 200 msec (winding operation can be managed based on the set time, the outer diameter, and a winding speed).

Alternatively, it may be possible to use the output voltage command value (see FIG. 7) of the winding motor 41 at the time of sliding the torque limiter 40 as a threshold, and detect termination of winding of the roll type medium M around the winding paper tube 44 when the output voltage command value of the winding motor 41 reaches the threshold. Details will be described later.

Further, FIG. 9 illustrates, at (e), operation of forming looseness after the roll type medium M is wound around the winding paper tube 44 after conveyance has been stopped. Through the control of forming the looseness as described above, it is possible to prevent a shock that may occur when conveyance is started due to pulling of the roll type medium M in opposite directions by the conveying roller 35 and the winding paper tube 44 during conveyance, and prevent skew caused by a difference in tension between the right side and the left side of the roll type medium M.

The control unit 61 first starts to cause the conveying roller 35 to convey the roll type medium M intermittently ((b) in FIG. 9). Then, the control unit 61 controls the winding paper tube 44 to rotate in the winding direction so as to perform winding such that looseness of a printing medium reaches a predetermined level or smaller at a predetermined timing after conveyance has been stated intermittently ((d) in FIG. 9). The control unit 61 controls the winding paper tube 44 to rotate in the direction opposite to the winding direction so as to give predetermined looseness to the roll type medium M ((e) in FIG. 9). Accordingly, it is possible to prevent deformation and occurrence of skew of the roll type medium M.

Further, when the looseness is formed, positioning control is continuously performed at the position in accordance with a motor rotation amount (i.e., a rotation amount of the winding paper tube 44) that is calculated on the basis of the outer diameter of the roll type medium M wound around the winding paper tube 44, in order to maintain a constant looseness amount. With this configuration, it is possible to set constant tension as the tension of the roll type medium M applied to a printing region on the platen 25, so that it is possible to improve image quality.

Furthermore, in some cases, if winding is continuously performed, the wound roll type medium M may be wound around the winding paper tube 44 in an eccentric manner. Such eccentricity frequently occurs due to, for example, a setting state of the roll type medium M for each of users, a state of the winding paper tube 44, or the like. However, in the image forming apparatus 100 according to the embodiment, it is possible to prevent inconvenience such as a situation in which it becomes difficult to wind the roll type medium M around the winding paper tube 44 due to occurrence of eccentricity.

Timing of Looseness Control

Figure 10:
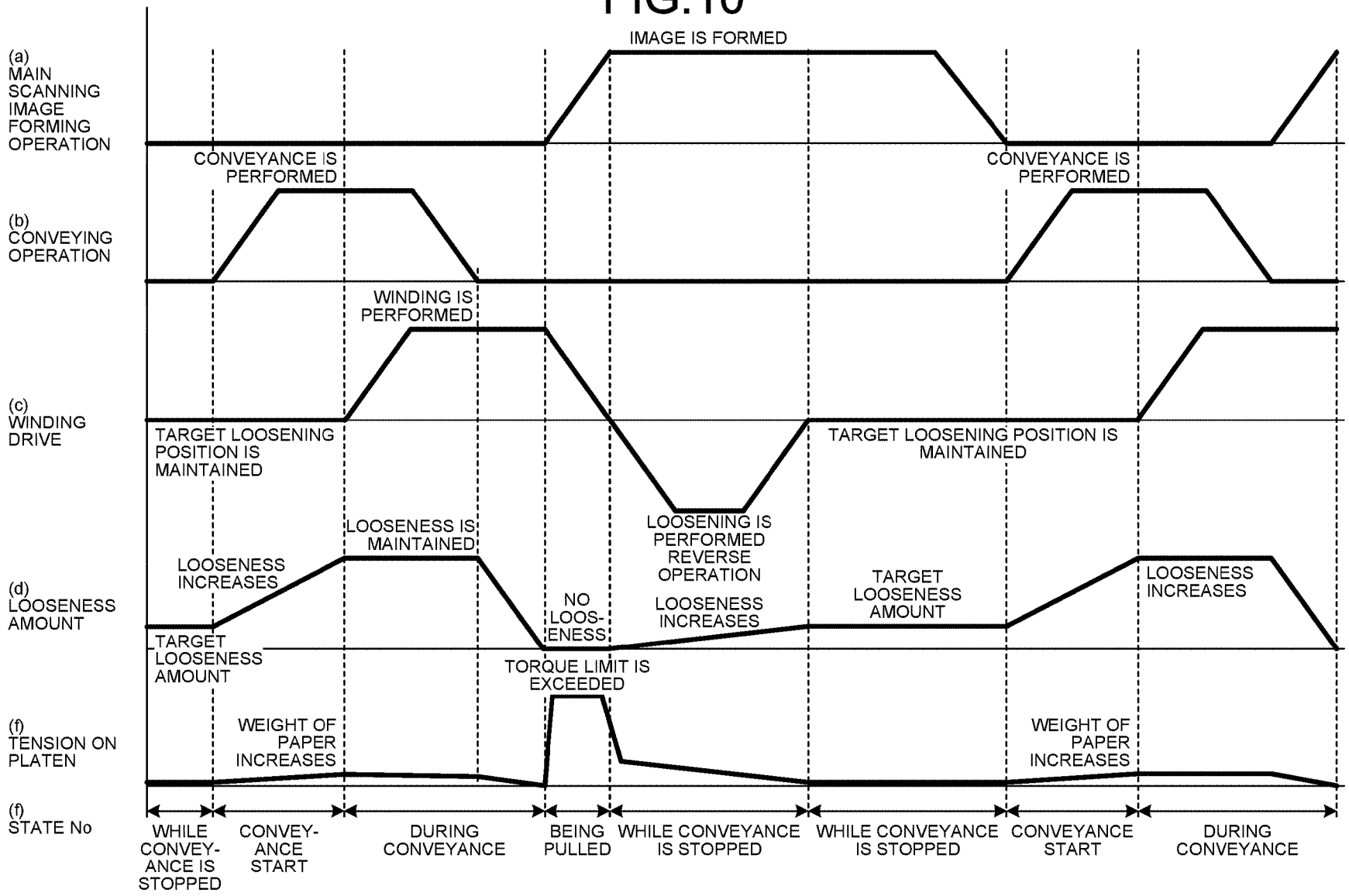
FIG. 10 is a time chart indicating a timing of a signal in each of units for explaining looseness control in the image forming apparatus according to the embodiment.

A timing of the looseness control as described above will be described below. FIG. 10 is a time chart indicating a timing of a signal in each of units, for explaining the looseness control. FIG. 10 illustrates, at (a), a timing to form an image by performing scanning in the main-scanning direction. FIG. 10 illustrates, at (b), a timing of operation of conveying the roll type medium M. FIG. 10 illustrates, at (c), a timing to drive winding of the roll type medium M. FIG. 10 illustrates, at (d), the looseness amount of the roll type medium M. FIG. 10 illustrates, at (e), a medium tension on the platen 25. FIG. 10 illustrates, at (f), a conveying state of the roll type medium M.

Conveyance of the roll type medium M is started as illustrated at (b) to (f) in FIG. 10, the roll type medium M is wound up such that there is no looseness as illustrated at (d) and (e) in FIG. 10 before image formation (before printing) is performed as illustrated at (a) in FIG. 10, predetermined looseness is given again, and printing is performed by the platen 25 with respect to the roll type medium M to which the predetermined looseness is given. With this operation, it is possible to perform printing while increasing flatness on the platen 25, so that it is possible to perform printing in a preferable manner.

Meanwhile, it may be possible to apply the tension to the roll type medium M at a timing before image formation or at a timing of image formation (during image formation) as illustrated at (a) in FIG. 10 as long as a certain level of tension that does not have a significant effect on the roll type medium M on the platen 25 is applied, for example. With this configuration, it is possible to improve productivity of printed products.

Further, it may be possible to give the predetermined looseness to the roll type medium M at a timing of image formation (during image formation) as illustrated at (a) in FIG. 10, for example. With this configuration, it is possible to improve productivity of printed products.

Meanwhile, as illustrated in FIG. 10, after conveyance (conveying operation) of the roll type medium M by the conveying roller 35 is completed intermittently, the control unit 61 controls rotation of the winding paper tube 44 such that the torque limiter 40 drivingly connected to the winding paper tube 44, slides and tension is applied to the roll type medium M.

Printing Operation

Figure 11:
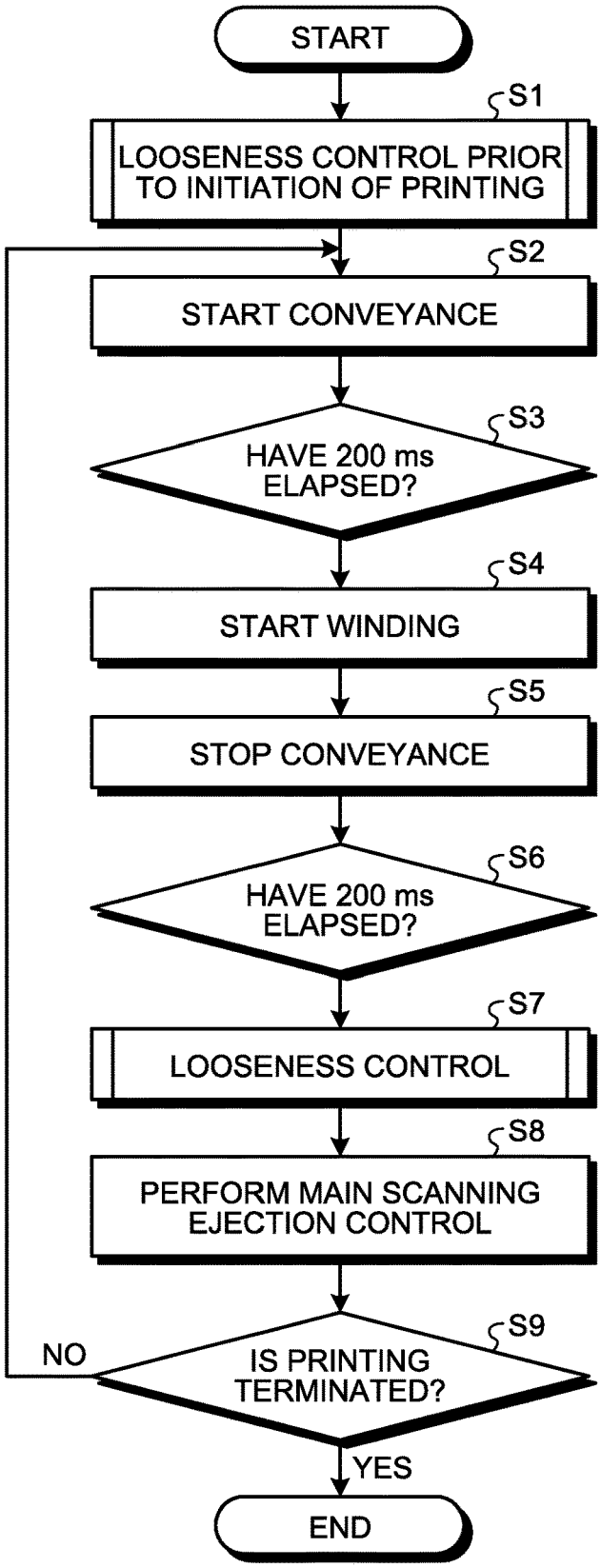
FIG. 11 is a flowchart illustrating the flow of printing operation performed by the image forming apparatus according to the embodiment.

FIG. 11 is a flowchart illustrating the flow of printing operation performed by the image forming apparatus according to the embodiment. In the flowchart in FIG. 11, first, as initial operation, the motor control unit 86 to the loosening instruction value calculating unit 89 as illustrated in FIG. 6 perform looseness control prior to initiation of printing, to thereby form predetermined looseness in the roll type medium M (Step S1), and thereafter start to convey the roll type medium M (Step S2).

If conveyance of the roll type medium M is started, the motor control unit 86 to the loosening instruction value calculating unit 89 wait for a lapse of a predetermined time, such as 200 msec (Step S3), and thereafter start to wind the roll type medium M (Step S4). If the winding of the roll type medium M is completed, the conveyance is stopped (Step S5).

In other words, the control unit 61 starts to rotate the winding paper tube 44 in the winding direction at a predetermined timing after the conveying roller 35 has started to convey the roll type medium M intermittently and before the conveyance is terminated intermittently.

Then, after a lapse of a predetermined time, such as 200 msec (Step S6), the motor control unit 86 causes the winding motor 41 to rotate reversely and performs looseness control of intentionally forming looseness in the roll type medium M (Step S7).

If the looseness is formed, positioning control is continuously performed at a target position in order to maintain a constant looseness amount, in accordance with the motor rotation amount (i.e., the rotation amount of the winding paper tube 44) that is calculated on the basis of the outer diameter of the roll type medium M wound around the winding paper tube 44. With this configuration, it is possible to set constant tension as the tension of the roll type medium M applied to a printing region on the platen 25. In this state, the printing control unit 85 performs ink ejection control (Step S8) until printing is terminated (Step S9).

Looseness Control Operation Prior to Initiation of Printing

The looseness control operation that is performed prior to initiation of printing and corresponds to Step S1 in FIG. 11 will be described below with reference to a flowchart in FIG. 12. The flowchart in FIG. 12 indicates a flow of operation of performing looseness control on the basis of the outer diameter of the wound roll type medium M before printing.

First, as illustrated in FIG. 3, the roll type medium M is attached to the paper feed paper tube 52 and the winding paper tube 44 and set to a state in which printing can be started and winding operation can be performed. When printing is to be started, a current winding state of the wound roll type medium M may be changed if a user exchanges the winding paper tube 44 or the like. Therefore, after an outer diameter value of the roll type medium M wound around the winding paper tube 44 is calculated again, looseness control as described below is performed and printing operation is performed. Meanwhile, in the following description, it is assumed that the outer diameter value of the roll type medium M wound around the winding paper tube 44 is calculated when operation of winding the roll type medium M is performed for 5 seconds (sec) and the roll type medium M is conveyed by 50 mm.

Figure 12:
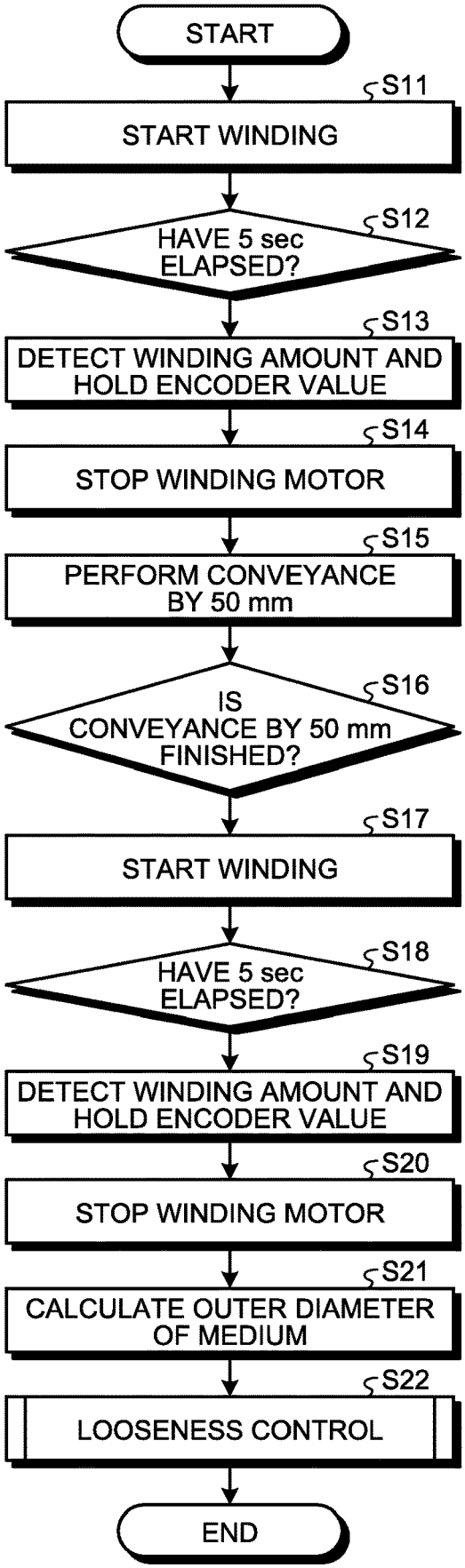
FIG. 12 is a flowchart illustrating the flow of looseness control operation that is performed prior to initiation of printing by the image forming apparatus according to the embodiment.

In the flowchart illustrated in FIG. 12, if winding is started (Step S11), the motor control unit 86, the sensor processing unit 87, and the winding amount detecting unit 88 control the winding motor 41 such that the roll type medium M is continuously wound around the winding paper tube 44 for 5 seconds, for example (Step S12). Accordingly, the roll type medium M is tightly wound around the winding paper tube 44. At this time, the looseness amount is 0 mm.

In this state, the winding amount detecting unit 88 holds an encoder value of the winding motor encoder sensor (Step S13). As one example, the held value is a value indicating a position corresponding to 100 pulses. If the encoder value is acquired as described above, the motor control unit 86, the sensor processing unit 87, and the winding amount detecting unit 88 causes the winding motor 41 to stop (Step S14).

Subsequently, the motor control unit 86, the sensor processing unit 87, and the winding amount detecting unit 88 cause the conveying roller 35 to convey the roll type medium M by 50 mm, for example (Step S15). If the roll type medium M has been conveyed by 50 mm (Step S16), the motor control unit 86, the sensor processing unit 87, and the winding amount detecting unit 88 controls the winding motor 41 such that the roll type medium M is wound for 5 seconds again (Step S17). If the roll type medium M is continuously wound for 5 seconds (Step S18), the looseness amount reaches 0 mm. The winding amount detecting unit 88 holds an encoder value of the winding motor encoder sensor 43 at the time the looseness amount reaches 0 mm (Step S19).

As one example, the held value is a value indicating a position corresponding to 200 pulses. If the encoder value is acquired as described above, the motor control unit 86, the sensor processing unit 87, and the winding amount detecting unit 88 causes the winding motor 41 to stop (Step S20).

Subsequently, the loosening instruction value calculating unit 89 calculates the outer diameter of the roll type medium M wound around the winding paper tube 44 (Step S21).

As one example, the loosening instruction value calculating unit 89 calculates the outer diameter of the roll type medium M using Equation (1) below.

$$\text{Outer diameter (mm) of roll type medium } M = \text{Circumference of roll type medium } M/\Pi \quad (1)$$

In Equation (1), the circumference of the roll type medium M is obtained such that "a conveying distance×(the number of pulses that correspond to the rotation of the winding paper tube 44 and that is detected by the winding encoder sensor 39/a differential pulse)"; therefore, assuming that the number of pulses that correspond to one rotation of the winding paper tube 44 and that are detected by the winding encoder sensor 39 and is 1000, the circumference of the roll type medium M is obtained such that "50 mm×(1000/100)=500 mm". Then, the outer diameter of the roll type medium M is obtained such that "500/Π (mm)". The looseness control as described below is performed on the basis of the outer diameter of the roll type medium M calculated as described above.

Looseness Control Operation

Figure 13:
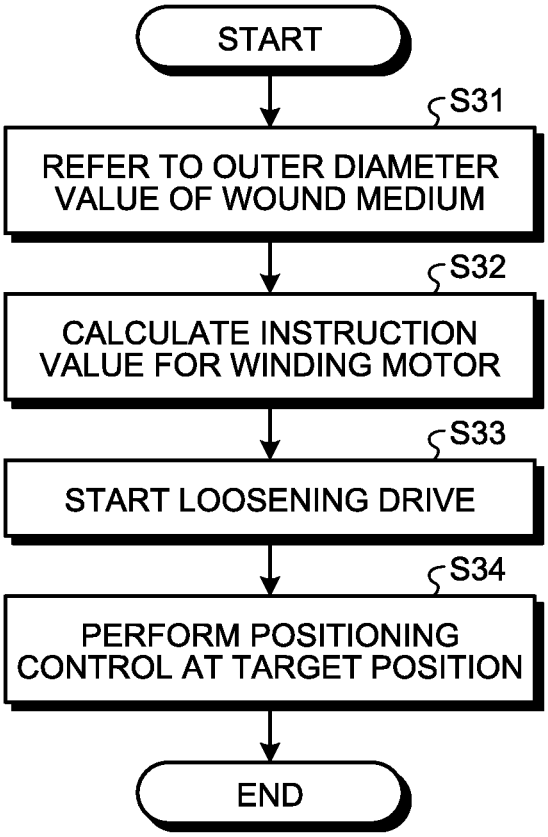
FIG. 13 is a flowchart illustrating the flow of the looseness control operation performed by the image forming apparatus according to the embodiment.

The looseness control that is performed at Step S7 in the flowchart of FIG. 11 and at Step S22 in the flowchart of FIG. 12 will be described below with reference to a flowchart in FIG. 13. Looseness control operation illustrated in the flowchart in FIG. 13 is operation of calculating a loosening instruction value on the basis of the outer diameter value of the wound roll type medium M calculated as described above, and controlling drive of the winding motor 41 by using the loosening instruction value as a target. Through the looseness control operation, appropriate "looseness" is intentionally generated.

Specifically, if the outer diameter of the roll type medium M is calculated as described above, the loosening instruction value calculating unit 89 acquires the calculated outer diameter value of the roll type medium M (Step S31), and calculates a loosening instruction value for controlling the rotation of the winding motor 41 based on Equation (2) below (Step S32).

$$\text{Loosening instruction value } (pls) = (\text{gear ratio between gear of winding paper tube 44 and gear of winding motor 41}) \times (\text{rotation amount of winding paper tube 44 } (pls)) \quad (2)$$

In Equation (2) for the loosening instruction value, the rotation amount of the winding paper tube 44 (*pls*) is calculated based on Equation (3) below.

$$\text{Rotation amount of winding paper tube 44 } (pls) = (\text{number of pulses corresponding to one rotation of encoder sheet 45}) \times (\text{looseness amount/circumference of wound roll type medium } M) \quad (3)$$

Further, the circumference of the wound roll type medium M in Equation (3) for the rotation amount of the winding paper tube 44 is calculated based on Equation (4) below.

$$\text{Circumference of wound roll type medium } M = (\text{outer diameter of wound roll type medium } M) \times (\Pi) \quad (4)$$

The motor control unit 86 starts to control rotation of the winding motor 41 on the basis of the loosening instruction value calculated as described above (Step S33), and if the winding motor 41 reaches a target position (designated stop position), the motor control unit 86 continues to perform positioning control at a target position (Step S34).

The looseness control as described above is repeated every time the roll type medium M is conveyed intermittently.

Meanwhile, it is explained that the winding motor 41 is controlled using the loosening instruction value that is calculated by Equation (2) for the loosening instruction value, but it may be possible to control the winding motor 41 by calculating, as a target position, the rotation amount of the winding paper tube 44 that is calculated using Equation (3) for the rotation amount of the winding paper tube 44.

Operation of Updating Outer Diameter Value of Roll Type Medium M

Figure 14:
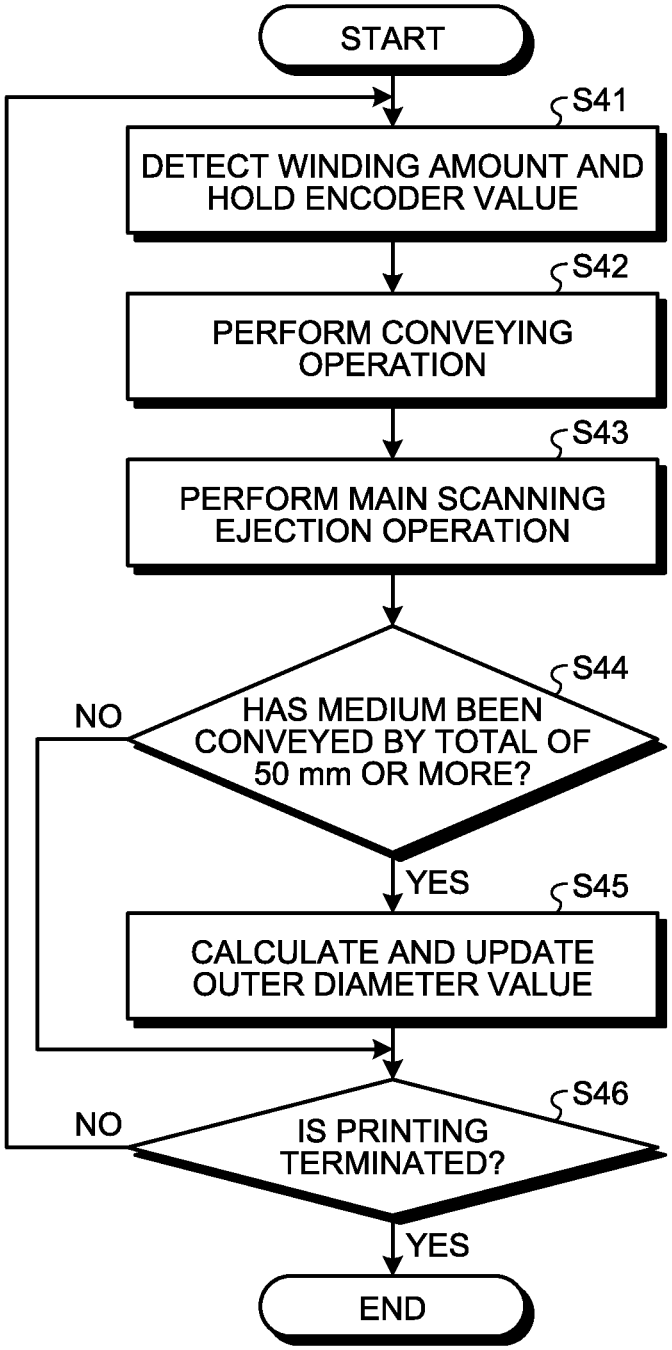
FIG. 14 is a flowchart for explaining operation of updating an outer diameter value of the roll type medium that is wound around the winding paper tube during printing.

Operation of updating the outer diameter value of the roll type medium M wound around the winding paper tube 44 during printing will be described below with reference to a flowchart in FIG. 14. A winding amount of the roll type medium M increases during printing, so that the outer diameter of the roll type medium M wound around the winding paper tube 44 increases; therefore, to maintain the same looseness amount, it is necessary to appropriately change an instruction value that is given to the winding motor 41. Therefore, parallel to the looseness control operation as described above, every time the roll type medium M is fed by, for example, 50 mm during printing, the outer diameter of the roll type medium M wound around the winding paper tube 44 is detected and updated.

Specifically, the winding amount detecting unit 88 first holds a current encoder value of the winding motor encoder sensor 43 (Step S41). Subsequently, the motor control unit 86 drives and rotates the main-scanning motor 8, the conveying motor 37, the paper feed motor 49, and the winding motor 41 so as to convey the roll type medium M (Step S42). Further, the printing control unit 85 controls ink ejection of the recording head 6, and controls printing along the main-scanning direction of the roll type medium M (Step S43).

Thereafter, the winding amount detecting unit 88 determines whether the roll type medium M has been conveyed by 50 mm or more since previous update of the encoder value of the winding motor encoder sensor 43. As one example, it is preferable to set a conveyance distance of the roll type medium M to about 50 mm to 100 mm. If the conveyance distance is shorter than 50 mm (NO at Step S44), the printing control unit 46 determines whether printing is terminated (Step S46). If it is determined that the printing is terminated (YES at Step S46), the process in the flowchart of FIG. 14 is terminated. If it is determined that the printing is continued (NO at Step S46), the process returns to Step S41, and conveyance control on the roll type medium M and printing control are performed.

In contrast, if it is determined that the roll type medium M has been conveyed by 50 mm or more (YES at Step S44), the winding amount detecting unit 88 calculates the current outer diameter value of the roll type medium M, and updates the current encoder value of the winding motor encoder sensor 43 (Step S45). Then, if it is determined that the printing is terminated at Step S46 (YES at Step S46), the process in the flowchart of FIG. 14 is terminated. If it is determined that the printing is continued at Step S46, the process returns to Step S41, so that the roll type medium M is conveyed by about 50 mm again and the encoder value of the winding motor encoder sensor 43 is detected and updated.

In this manner, during printing, the outer diameter value of the roll type medium M is repeatedly detected for every certain conveyance distance (every time conveyance is performed intermittently). After printing/conveying operation is repeated a plurality of number of times, and after the roll type medium M is conveyed by a total of 50 mm or more (about 50 mm to 100 mm are acceptable) since previous update, the winding outer diameter value is calculated and updated before next conveying operation.

Change of Outer Diameter Value and Change of Encoder Pulse

Figure 15A:
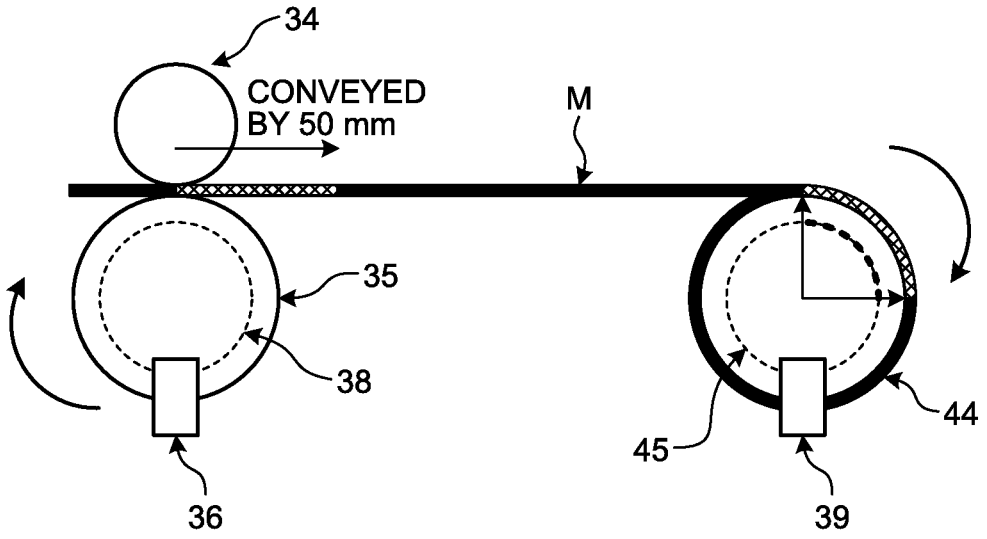
FIGS. 15A and 15B are diagrams for explaining a change of the outer diameter value of the roll type medium that is wound around the winding paper tube and a change of an encoder pulse.
Figure 15B:
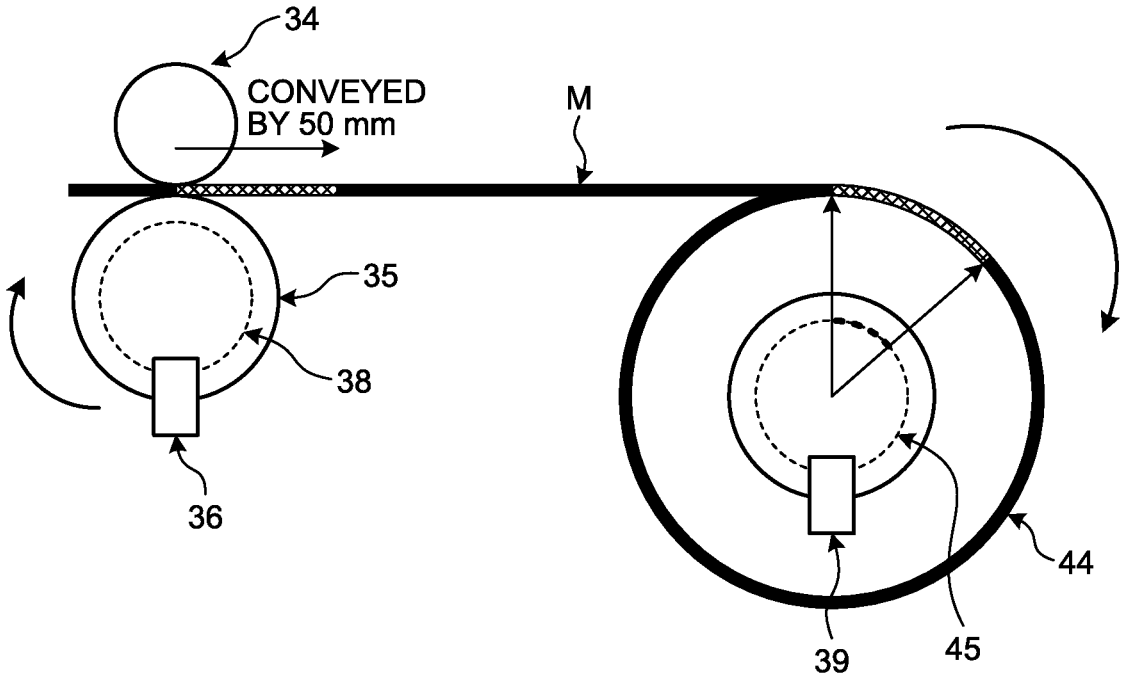

FIGS. 15A and 15B are a diagram for explaining a change of the outer diameter value of the roll type medium M that is wound around the winding paper tube 44 and a change of the encoder pulse. FIG. 15A illustrates a state in which a small amount of the roll type medium M has been wound around the winding paper tube 44. In the state as illustrated in FIG. 15A, an amount of change of the encoder pulse detected by the winding encoder sensor 39 increases. In contrast, FIG. 15B illustrates a state in which a large amount of the roll type medium M has been wound around the winding paper tube 44. As illustrated in FIG. 15B, with an increase in the outer diameter of the winding paper tube 44, the amount of change (rotation angle) of the encoder pulse decreases and the number of changing pulses also decreases.

Specifically, the rotation angle of the winding paper tube 44 changes depending on the outer diameter of the roll type medium M that has been wound around the winding paper tube 44, so that the number of pulses of the encoder pulse changes. Therefore, the loosening instruction value calculating unit 89 calculates an instruction value that is changed in accordance with the outer diameter of the roll type medium M wound around the winding paper tube 44. Consequently, even if the outer diameter of the roll type medium M wound around the winding paper tube 44 is changed, it is possible to maintain a constant looseness amount as the looseness amount of the roll type medium M. Further, the outer diameter of the roll type medium M can be calculated based on a change of the number of pulses of the encoder pulse detected by the winding encoder sensor 39.

Winding Complete Detection Operation

Operation of detecting completion of winding of the entire roll type medium M fed from the paper feed paper tube 52 onto the winding paper tube 44 will be described below. As one example, in the case of the image forming apparatus 100 according to the embodiment, completion of winding is detected on the basis of a voltage command value that is supplied to the winding motor 41 whose speed is controlled.

Specifically, if the entire roll type medium M is wound around the winding paper tube 44 (if winding is completed), it becomes impossible to wind the roll type medium M, so that the torque limiter 40 starts to slide. Even in a state in which the torque limiter 40 slides and a load increases, the motor control unit 86 performs operation of increasing the voltage value to be supplied to the winding motor 41 in order to maintain the rotation speed. The increased voltage value and a threshold for detecting the increased voltage value are set and stored in advance. Then, if the winding amount detecting unit 88 continuously detects voltage values that exceed the threshold for a predetermined time, completion of the winding is detected.

Figure 16:
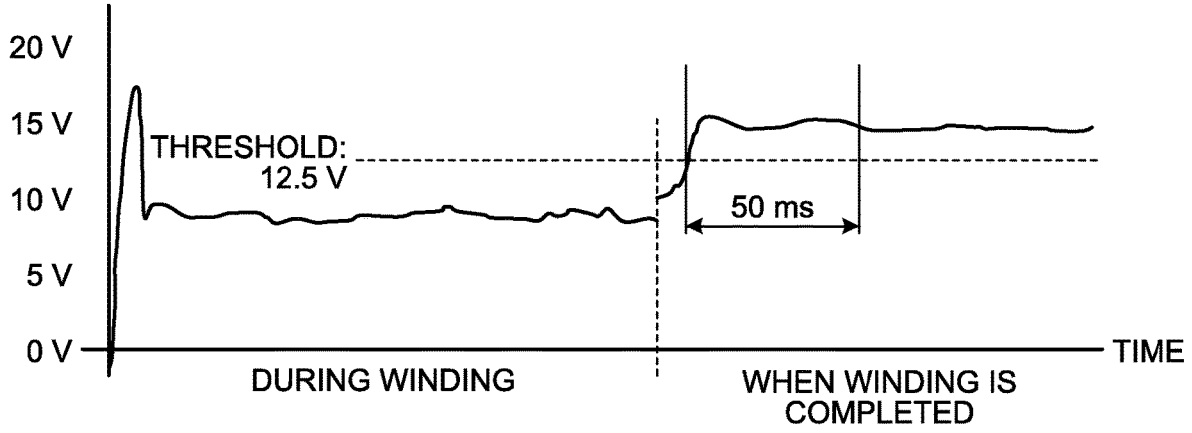
FIG. 16 is a diagram illustrating a change of a voltage value that is supplied from a motor control unit to the winding motor during winding of the roll type medium and after completion of the winding.

Specifically, FIG. 16 illustrates the voltage value that is supplied from the motor control unit 86 to the winding motor 41. As one example, in this example, 12.5 volts (V) is set as the threshold. As illustrated in FIG. 16, during winding of the roll type medium M, the winding motor 41 is driven at a certain voltage below the threshold. However, if winding of the roll type medium M is completed, the voltage value supplied from the motor control unit 86 to the winding motor 41 increases and exceeds the threshold in order to maintain the number of rotations of the winding motor 41 that has stopped rotation.

If the time during which the voltage values continuously exceed the threshold is equal to or longer than a predetermined time, such as 50 msec, the winding amount detecting unit 88 determines that the winding of the roll type medium M is completed.

Modification of Winding Completion Detection Operation

In the example illustrated in FIG. 16, completion of the winding is detected based on the voltage value supplied to the winding motor 41. However, as described below, it may be possible to detect completion of the winding based on the number of pulses of the encoder pulse detected by the winding encoder sensor 39.

Figure 17:
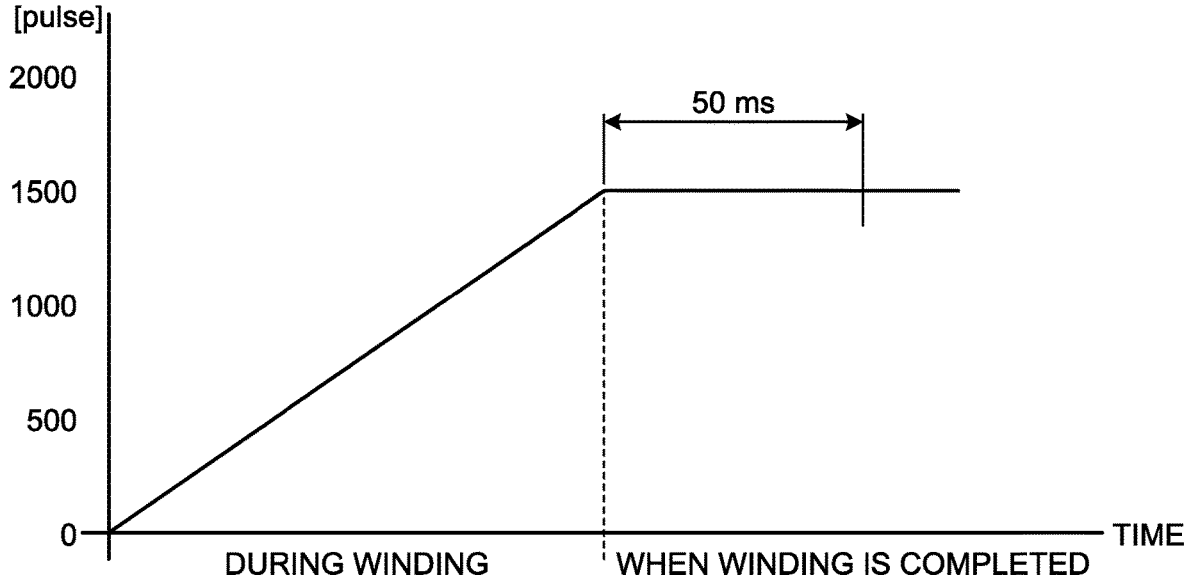
FIG. 17 is a diagram illustrating a change of a pulse number of the encoder pulse that is detected by a winding encoder sensor during winding of the roll type medium and after completion of the winding.

As illustrated in FIG. 17, during winding, the number of pulses of the encoder pulse detected by the winding encoder sensor 39 gradually increases. However, if the winding is completed, the rotation of the winding paper tube 44 is stopped, so that the number of pulses of the encoder pulse detected by the winding encoder sensor 39 is maintained at a certain level.

Therefore, if the winding amount detecting unit 88 continuously detects a certain number of pulses for a predetermined time, such as 50 msec, the winding amount detecting unit 88 determines that the winding of the roll type medium M is completed.

Effects of Embodiment

Effects of the embodiment will be described below. For easier understanding of the effects of the embodiment, inconvenience such as a gradual increase in looseness of the winding paper tube and occurrence of a problem, such as skew, when the present invention is not applied will be described below.

Figure 18:
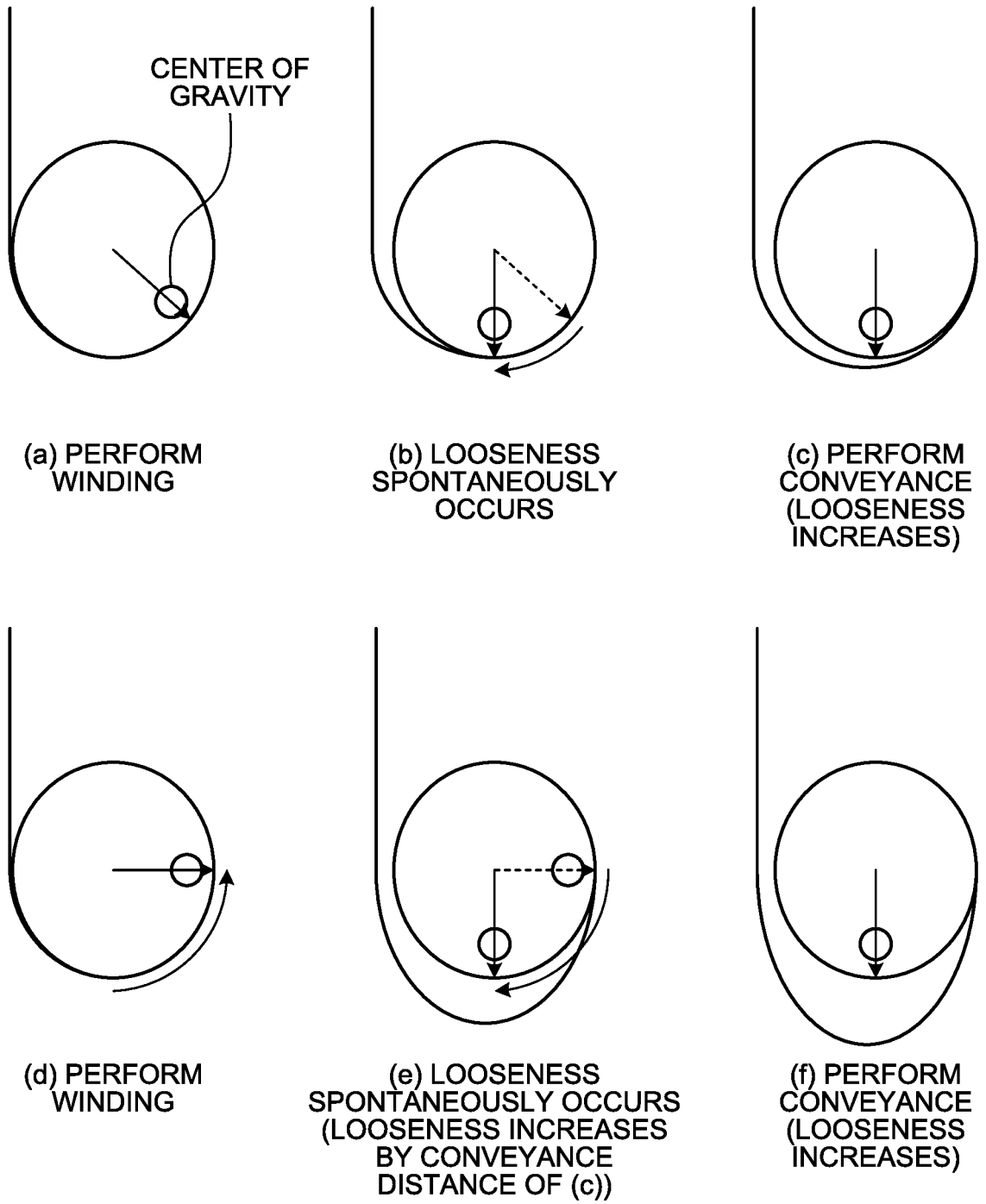
FIG. 18 is a diagram for explaining the principle of occurrence of looseness of the roll type medium wound by the winding paper tube.

FIG. 18 is a diagram illustrating how looseness of the winding paper tube increases when the present invention is not applied. When the roll type medium M is continuously wound, the center of gravity may be inclined. This is because it is difficult to wind the roll type medium M in an ideal condition without eccentricity, such as in the same condition as new, due to the influence of the way to set sheets by a user or a state of the winding paper tube.

Specifically, FIG. 18 illustrates, at (a), a state in which winding of the roll type medium M around the winding paper tube 44 by the winding motor 41 is completed. In this state, the winding motor is still driven. Further, the center of gravity is located at a diagonally lower right position in the winding paper tube 44, for example.

In this state, if winding of the roll type medium M is stopped (if the winding motor 41 is stopped), the center of gravity moves to a stable position due to the gravity of the earth, so that as illustrated at (b) in FIG. 18, the center of gravity moves to a bottom position in the winding paper tube 44. Due to the movement of the center of gravity, looseness occurs in the roll type medium M wound around the winding paper tube 44. If the roll type medium M is conveyed in the state in which the looseness has occurred as described above, further looseness occurs in the roll type medium M as illustrated at (c) in FIG. 18.

Therefore, if the roll type medium M is wound again to eliminate the looseness that has occurred, the roll type medium M is wound in the state in which the further looseness has occurred, so that the position of the center of gravity moves to a right position in the winding paper tube 44 as illustrated at (d) in FIG. 18, for example.

However, the center of gravity moves to the stable position due to the gravity of the earth, so that the center of gravity moves to the bottom position in the winding paper tube 44 as illustrated at (e) in FIG. 18 and looseness is further increased as illustrated at (f) in FIG. 18.

If the center of gravity is located at the right position in the winding paper tube 44, the states as illustrated at (d) to (f) in FIG. 18 are repeated, so that the looseness of the roll type medium M is gradually increased. In other words, while the roll type medium M is fed by conveyance, the states of winding, loosening, and re-winding are repeated, so that the loosening is gradually increased.

In contrast, if the center of gravity is located at a left position in the winding paper tube 44, tension is gradually applied to the roll type medium M, so that inconvenience such as an increase in skew occurs.

In this manner, if the looseness of the roll type medium M is increased, the printed roll type medium M hangs down to the ground and gets dirty. Further, the roll type medium M may be stuck inside the image forming apparatus or on the ground, so that the printing surface of the platen 25 may be lifted up and come in contact with the carriage 5, which is a problem.

However, in the case of the image forming apparatus according to the embodiment, the roll type medium M that has loosened due to conveyance is wound up until the looseness is eliminated, and thereafter, the winding motor 41 is controlled to rotate reversely so as to intentionally generate a predetermined amount of looseness such that the looseness amount of the roll type medium M is set to an appropriate looseness amount. Then, the predetermined looseness amount is maintained. With this configuration, it is possible to maintain the predetermined looseness amount, so that it is possible to prevent inconvenience such as an increase in the looseness of the roll type medium M and inconvenience such as a gradual increase in the tension applied to the roll type medium M and an increase in skew.

Furthermore, when the roll type medium M that has loosened due to conveyance is continuously wound until the looseness is eliminated, and if a voltage equal to or larger than a threshold is applied to the winding motor 41 for a predetermined time or longer, it is determined that the looseness of the roll type medium M is eliminated (see FIG. 16). With this configuration, it is possible to minimize a time taken to wind the roll type medium M around the winding paper tube 44, so that it is possible to minimize damage of the roll type medium M.

Moreover, when the roll type medium M that has loosened due to conveyance is continuously wound until the looseness is eliminated, and if a predetermined number of encoder pulses are detected for a predetermined time or longer, it is determined that the looseness of the roll type medium M is eliminated (see FIG. 17). With this configuration, it is possible to minimize a time taken to wind the roll type medium M around the winding paper tube 44, so that it is possible to minimize damage of the roll type medium M.

Furthermore, the winding motor encoder sensor 43 for performing feedback control on the winding motor 41, and the winding motor encoder sensor 43 for detecting the rotation amount of the winding paper tube 44 (more precisely, the flange 54 that holds the winding paper tube 44) are provided. The outer diameter of the wound roll type medium M is calculated from the conveying amount of the roll type medium M and the rotation amount of the winding paper tube 44. Further, the rotation amount of the winding paper tube 44 is determined so as to achieve the predetermined looseness amount, on the basis of the outer diameter of the wound roll type medium M. Then, a reverse rotation amount of the winding motor 41 is determined on the basis of the determined rotation amount. With this configuration, it is possible to indirectly control the rotation angle of the winding paper tube 44 by the winding motor encoder sensor 43 of the winding motor 41, so that it is possible to simplify control of the winding motor 41.

Alternatively, the winding motor encoder sensor 43 for performing feedback control on the winding motor 41, and the winding motor encoder sensor 43 for detecting the rotation amount of the winding paper tube 44 (more precisely, the flange 54 that holds the winding paper tube 44) are provided. The outer diameter of the wound roll type medium M is calculated from the conveying amount of the roll type medium M and the rotation amount of the winding paper tube 44. Further, the rotation amount of the winding paper tube 44 is determined so as to achieve the predetermined looseness amount, on the basis of the outer diameter of the wound roll type medium M. Then, positioning control is performed by the winding motor 41 such that an encoder value of the winding motor encoder sensor 43 reaches a value of a predetermined looseness amount. With this configuration, it is possible to control the rotation angle of the winding paper tube 44 by directly monitoring the rotation angle, so that it is possible to control the looseness amount with high accuracy.

Furthermore, the rotation speed of the winding motor 41 is controlled so as to maintain a certain looseness amount, in accordance with the outer diameter of the roll type medium M wound around the winding paper tube 44. With this configuration, it is possible to wind the roll type medium M while maintaining the certain looseness amount, without being influenced by the outer diameter of the roll type medium M wound around the winding paper tube 44. Therefore, it is possible to control the rotation speed of the winding motor 41 and complete the winding process within a predetermined time.

Moreover, printing is performed after conveyance of the roll type medium M is completed. If the roll type medium M is made of fabric, it is necessary to perform conveyance by the conveying roller 35 and perform conveyance by winding the roll type medium M while pulling the roll type medium M by the winding side. Therefore, printing is performed after the conveyance of the roll type medium M is completed so that the printing can be performed after winding is certainly performed. With this configuration, it is possible to accurately perform printing even on the roll type medium M made of fabric.

Furthermore, outer diameter detection and looseness control on the roll type medium M wound around the winding paper tube 44 are performed as initial operation before printing is started. With this configuration, even if the state of the winding paper tube 44 is changed by a user during a job for example, it is possible to generate a desired looseness amount.

According to an embodiment, it is possible to prevent deformation of a printing medium and occurrence of skew, and improve printing quality.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid ejection apparatus comprising:

a conveying unit configured to intermittently convey a printing medium by a predetermined feed amount;

a winding unit configured to wind the printing medium conveyed by the conveying unit;

a printing unit configured to perform printing on the conveyed printing medium; and a rotation control unit configured to control the winding unit to rotate in a winding direction at a predetermined timing after the conveying unit has started to convey the printing medium intermittently, and then cause the winding unit to rotate in a reverse direction opposite to the winding direction, wherein the rotation control unit is configured to control the winding unit to rotate in the winding direction and the reverse direction every time the conveying unit conveys the printing medium intermittently.

2. The liquid ejection apparatus according to claim 1, wherein the rotation control unit is configured to start to control the winding unit to rotate in the winding direction at a predetermined timing after the conveying unit has started to convey the printing medium intermittently and before conveyance is completed intermittently.

3. The liquid ejection apparatus according to claim 1, further comprising:

a torque limiter drivingly connected to the winding unit, wherein the rotation control unit is configured to control rotation of the winding unit such that the torque limiter slides and gives tension to the printing medium after the conveying unit completes conveyance of the printing medium intermittently.

4. The liquid ejection apparatus according to claim 1, wherein the rotation control unit is configured to control the winding unit to rotate in the winding direction such that looseness of the printing medium reaches a predetermined level or lower at a timing after the conveying unit has started to convey the printing medium intermittently, and then control the winding unit to rotate in the reverse direction opposite to the winding direction such that a predetermined amount of looseness is given to the printing medium.

5. The liquid ejection apparatus according to claim 4, wherein the rotation control unit is configured to determine that the looseness of the printing medium reaches the predetermined level or lower when a control voltage for controlling rotation of the winding unit is a certain control voltage that is higher than a normal voltage for a predetermined time or longer.

6. The liquid ejection apparatus according to claim 4, wherein the rotation control unit is configured to determine that the looseness of the printing medium reaches the predetermined level or lower when a number of rotation pulses that are obtained by controlling rotation of the winding unit is a predetermined number of rotation pulses for a predetermined time or longer.

7. The liquid ejection apparatus according to claim 4, wherein the rotation control unit is configured to determine a rotation amount of the winding unit for giving a predetermined looseness amount to the printing medium, based on an outer diameter of the printing medium that has been wound by the winding unit, the outer diameter being calculated from a conveying amount of the printing medium by the conveying unit and a rotation amount of the winding unit, and control the winding unit to rotate in the reverse direction by the determined rotation amount.

8. The liquid ejection apparatus according to claim 4, wherein the rotation control unit is configured to determine a rotation amount of the winding unit for giving a predetermined looseness amount to the printing medium, based on an outer diameter of the printing medium that has been wound by the winding unit, the outer diameter being calculated from a conveying amount of the printing medium by the conveying unit and a rotation amount of the winding unit, and controls rotation of the winding unit such that a number of rotation pulses that are obtained by controlling the winding unit to rotate in the reverse direction reaches a certain number of rotation pulses corresponding to the determined rotation amount.

9. The liquid ejection apparatus according to claim 7, wherein the rotation control unit is configured to perform, as initial operation that is performed prior to initiation of printing, looseness control of giving a predetermined amount of looseness to the printing medium by controlling the winding unit to rotate in the reverse direction after the outer diameter of the printing medium wound by the winding unit is detected and the printing medium is wound until the looseness reaches a predetermined level or lower.

10. The liquid ejection apparatus according to claim 8, wherein the rotation control unit is configured to perform, as initial operation that is performed prior to initiation of printing, looseness control of giving a predetermined amount of looseness to the printing medium by controlling the winding unit to rotate in the reverse direction after the outer diameter of the printing medium wound by the winding unit is detected and the printing medium is wound until the looseness reaches a predetermined level or lower.

11. The liquid ejection apparatus according to claim 4, wherein the rotation control unit controls a rotation speed of the winding unit such that a predetermined looseness amount of the printing medium is maintained, in accordance with an outer diameter of the printing medium wound by the winding unit.

12. The liquid ejection apparatus according to claim 4, wherein the printing unit is configured to perform printing on the printing medium that has been wound by the winding unit such that the looseness reaches a predetermined level or lower and then been given a predetermined looseness amount by being rotated in the reverse direction.

13. A winding control method implemented by a liquid ejection apparatus the liquid ejection apparatus including:

a conveying unit configured to intermittently convey a printing medium by a predetermined feed amount;

a winding unit configured to wind the printing medium conveyed by the conveying unit; and a printing unit configured to perform printing on the conveyed printing medium, the winding control method comprising:

controlling, by a rotation control unit, the winding unit to rotate in a winding direction at a predetermined timing after the conveying unit has started to convey the printing medium intermittently; and controlling, by the rotation control unit, the winding unit to rotate in a reverse direction opposite to the winding direction after the winding unit has been controlled to rotate in the winding direction, wherein the controlling by the rotation control unit to rotate the winding unit in the winding direction and the reverse direction occurs every time the conveying unit conveys the printing medium intermittently.

14. A liquid ejection apparatus comprising:

a conveying unit configured to intermittently convey a printing medium by a predetermined feed amount;

a winding unit configured to wind the printing medium conveyed by the conveying unit;

a printing unit configured to perform printing on the conveyed printing medium; and a rotation control unit configured to control the winding unit to rotate in a winding direction at a predetermined timing after the conveying unit has started to convey the printing medium intermittently, and then cause the winding unit to rotate in a reverse direction opposite to the winding direction, wherein the rotation control unit is configured to control the winding unit to rotate in the winding direction such that looseness of the printing medium reaches a predetermined level or lower at a timing after the conveying unit has started to convey the printing medium intermittently, and then control the winding unit to rotate in the reverse direction opposite to the winding direction such that a predetermined amount of looseness is given to the printing medium.

* * * * *